US005759017A

United States Patent [19]

Patton et al.

[11] Patent Number: 5,759,017

[45] Date of Patent: Jun. 2, 1998

[54] PERISTALTIC PUMP AND TUBE LOADING SYSTEM

[75] Inventors: Mark T. Patton, Denver; Jacek Lasota, Thornton, both of Colo.

[73] Assignee: Medtronic Electromedics, Inc., Parker, Colo.

[21] Appl. No.: 790,073

[22] Filed: Jan. 28, 1997

Related U.S. Application Data

[60] Provisional application No. 60/010,923, Jan. 31, 1996.

[51] Int. Cl.[6] ..... F04B 43/12

[52] U.S. Cl. ..... 417/477.9; 417/477.11; 417/477.7

[58] Field of Search ..... 417/477.7, 477.9, 417/477.11

[56] References Cited

U.S. PATENT DOCUMENTS 4,231,725 11/1980 Hogan ..... 417/477.11
4,363,609 12/1982 Consentino et al. ..... 417/477.7 X

*Primary Examiner*—Timothy Thorpe
*Assistant Examiner*—Cheryl J. Tyler
*Attorney, Agent, or Firm*—Ancel W. Lewis, Jr.

[57] ABSTRACT

A peristaltic pump and tube body system disclosed includes a pump housing, a pump rotor rotatably mounted in the housing, and a motor for driving the rotor. The housing has a pair of opposed side walls hinged and releasably latched to the housing whereby insertion and removal of a pump tube is facilitated. The rotor has two rollers disposed at 180 degrees to one another together with opposed rigid bearing surfaces inside the housing which squeeze the latch to produce a pumping action when the rotor is rotated in either direction.

23 Claims, 6 Drawing Sheets

PERISTALTIC PUMP AND TUBE LOADING SYSTEM

TECHNICAL FIELD

This invention relates to blood separating apparatus and more particularly to a peristaltic pump and tube loading system particularly suitable for use in blood separation apparatus.

BACKGROUND ART

The peristaltic pumps and tube loading systems heretofore provided for blood separation have frequently used more than two rollers and have not provided rigid or locked surfaces opposite the rollers and have not been particularly easy to operate in removing the tube from the pump housing.

DISCLOSURE OF THE INVENTION

A peristaltic pump and tube loading system disclosed has a housing enclosing a rotor and supporting a tube in a U-shaped configuration with side walls of the housing hinged to separate to allow the tube to be readily inserted and removed and provide rigid bearing surfaces opposite a pair of opposed rollers on the rotor. The rotor rotates to squeeze the tube between the rollers and bearing surfaces.

BRIEF DESCRIPTION OF THE DRAWINGS

Details of this invention are described in connection with the accompanying drawings which like parts bear similar reference numerals in which.

DETAILED DESCRIPTION

Figure 1:
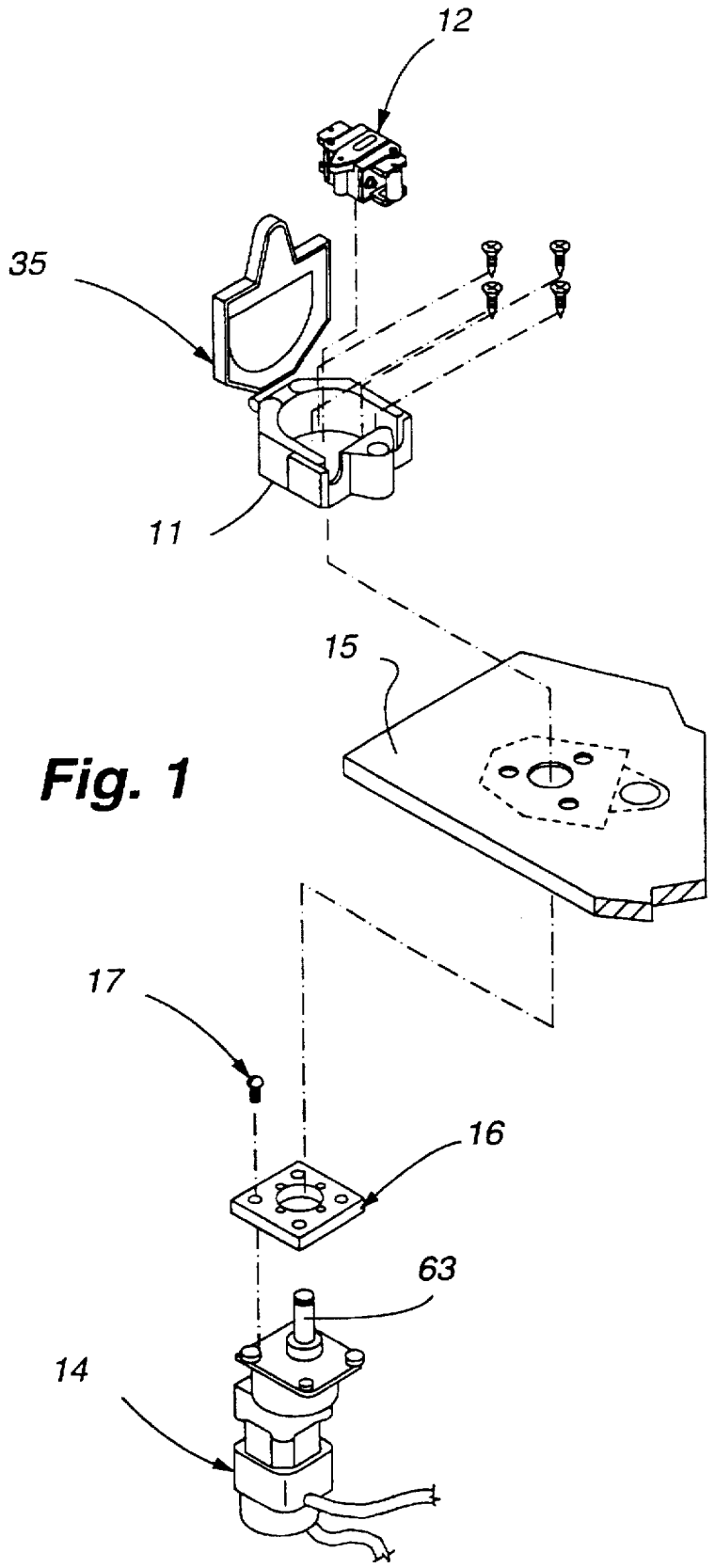
FIG. 1 is an exploded view of a peristaltic pump and tube loading system embodying the present invention.
Figure 2:
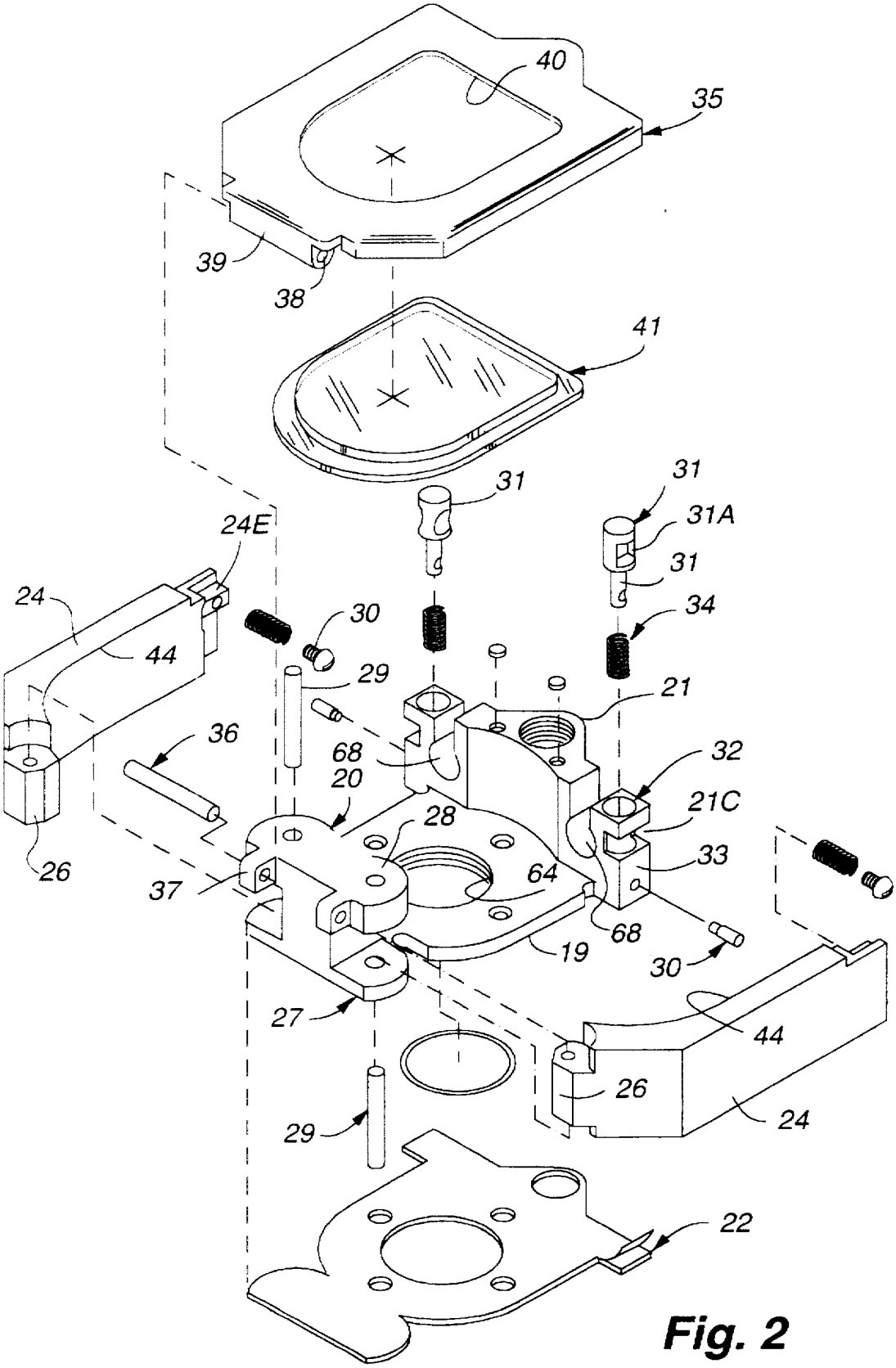
FIG. 2 is an enlarged exploded view of the housing shown in FIG. 1.
Figure 3:
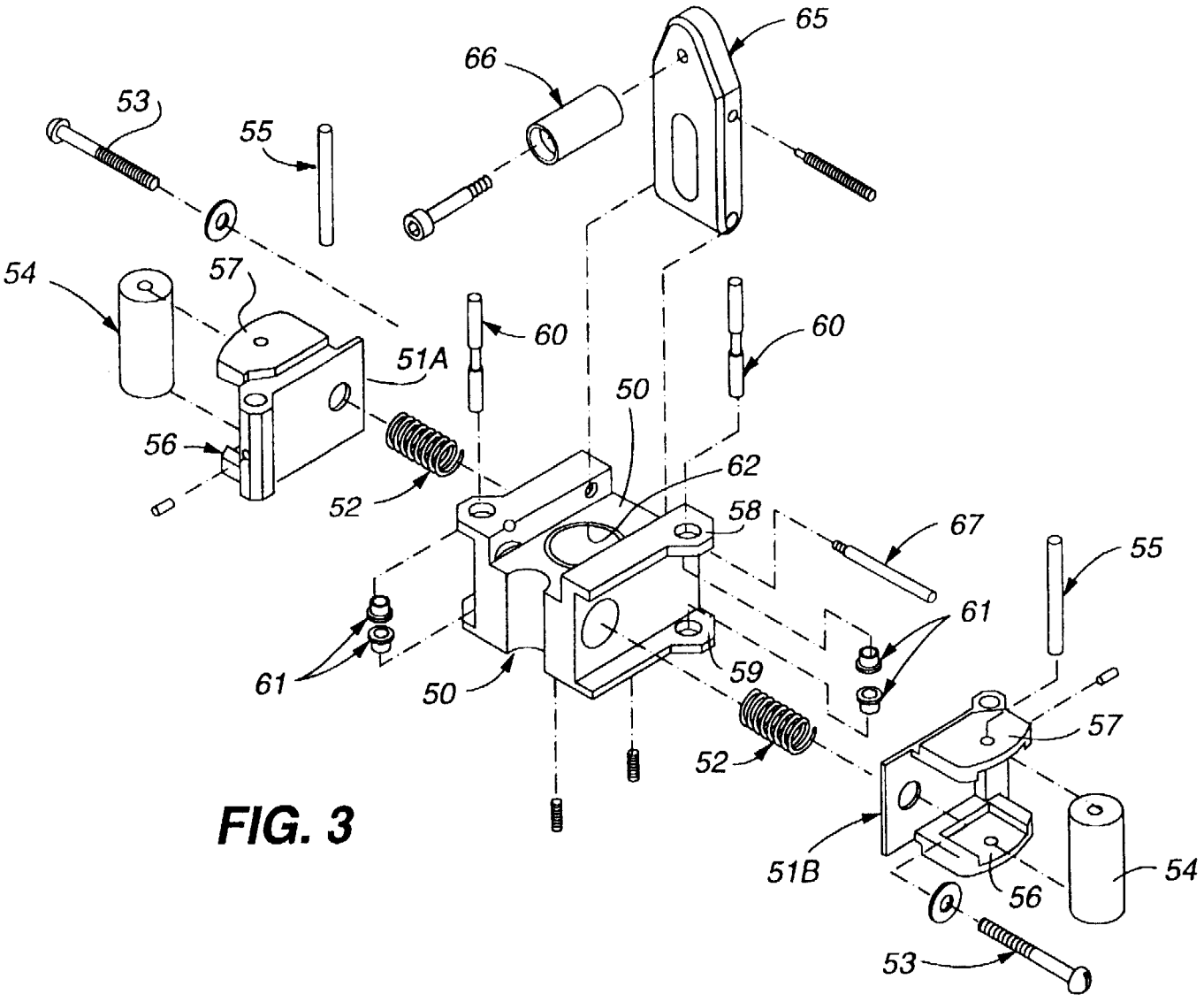
FIG. 3 is an enlarged exploded view of the peristaltic pump rotor shown in FIG. 1.
Figure 4:
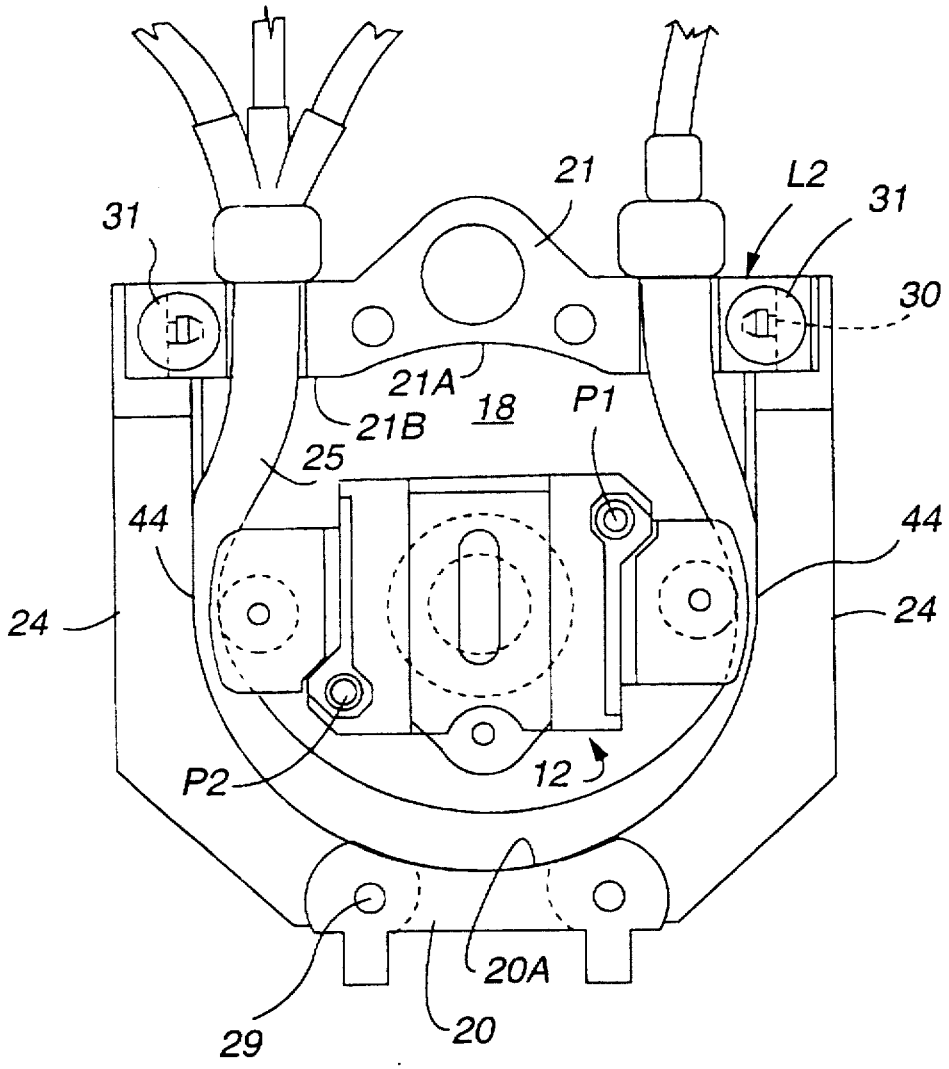
FIG. 4 is a top plan view showing the peristaltic pump and inserted tube with the arms in the latched position.
Figure 4A:
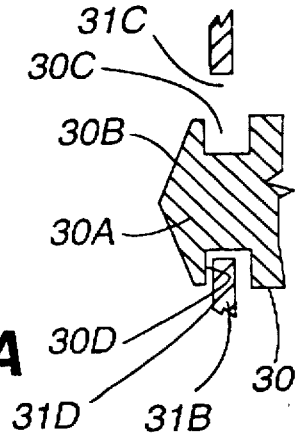
FIG. 4A is a fragmentary view showing the latch pin engaged by the latch plate in a latched position.
Figure 5:
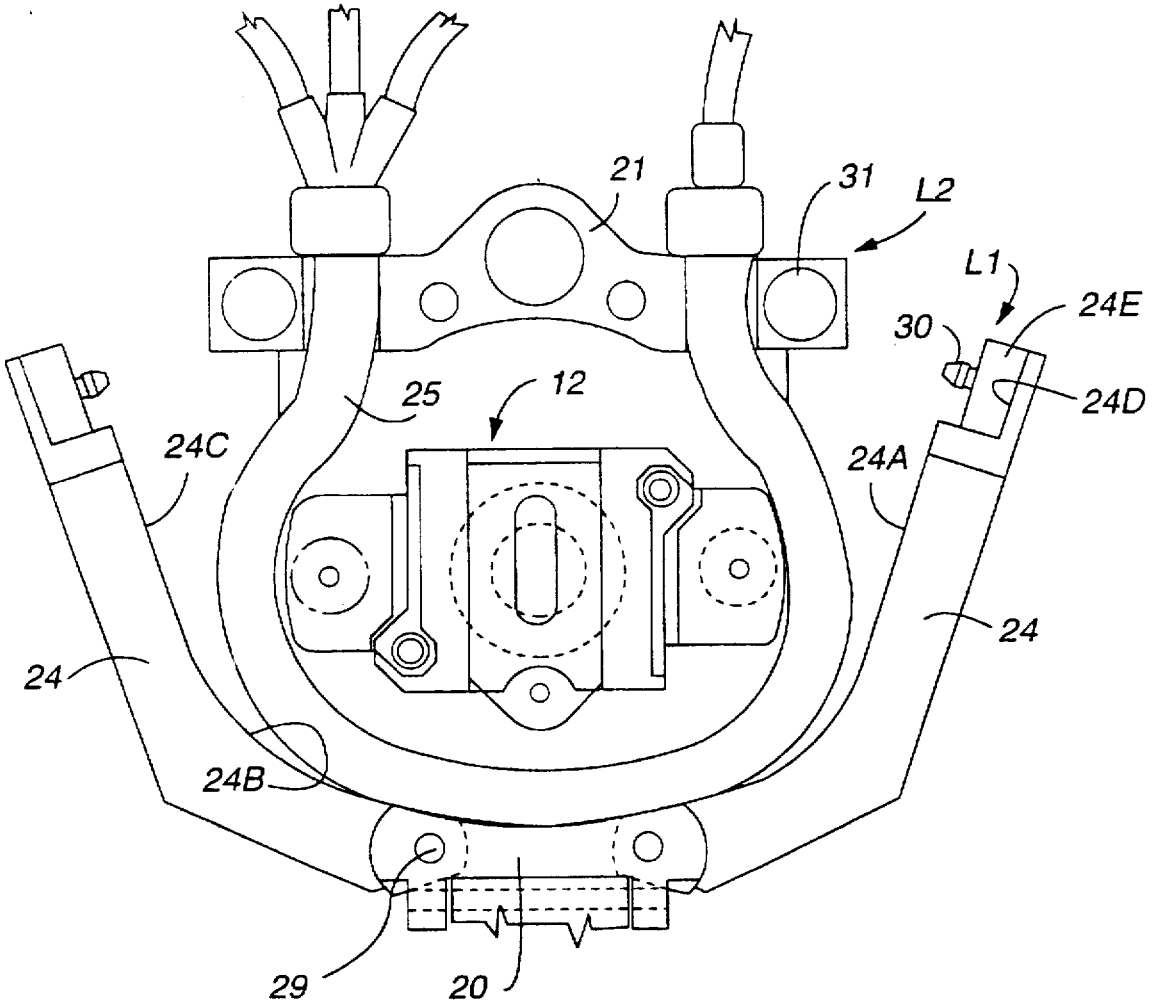
FIG. 5 is a top plan view showing the side walls in a spread position.
Figure 6:
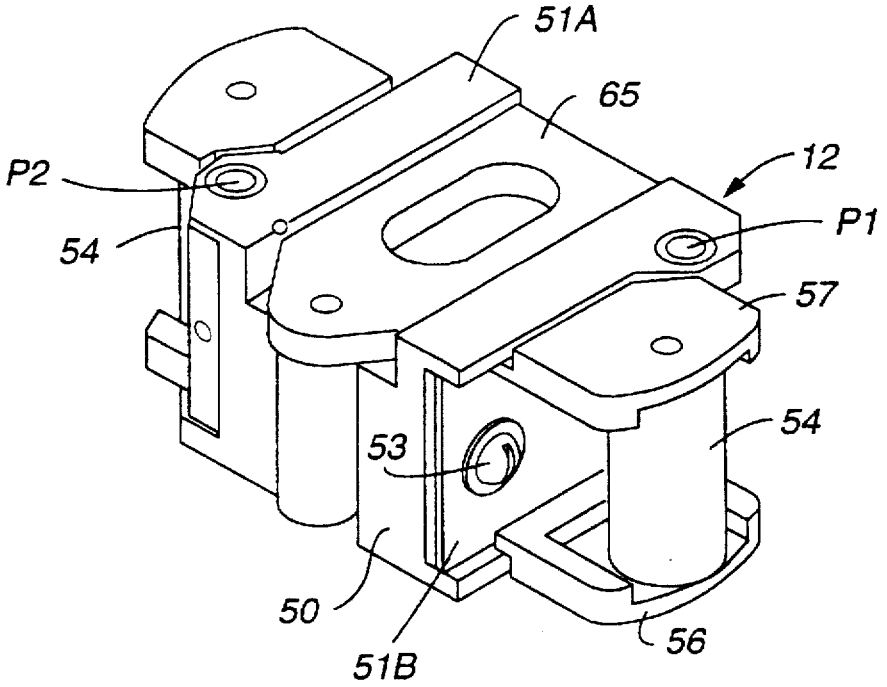
FIG. 6 is a perspective view of the rotor.

Generally stated, the peristaltic pump 10 embodying the present invention includes a pump housing 11 enclosing a rotor 12 driven by a motor 14. The housing is adapted to be mounted on a housing platform or tray 15 as shown in FIG. 1. The pump is secured to the housing tray by an adaptor plate 16 and appropriate bolts 17. A fluid tube 25 held in the shape of a U is shown mounted inside the housing with two end portions of the tube extending beyond the housing.

The pump housing 11 has a base 19, a hinge block 20 at one end of the base, a guide and latch block 21 opposite and in spaced relation to the hinge block, a pair of spaced side walls 24 extending between opposite ends of the blocks 20 and 21 to define a top opening in the housing and an inner cavity 18 shaped to receive and support a tube 25 in a U-shaped configuration with end portions of the tube extending through two spaced, tube exit openings 68 in the guide and latch block 21. A gasket or pad 22 is positioned between the base 19 and the housing tray 15.

The hinge block 20 is in the form of an upright first end wall extending up from a first end portion of the base 19 and is symmetrical with respect to the longitudinal center line of the housing so there is identical structure on both sides of this center line so that a description of one side also applies to the other side. The hinge block 20 has an arcuate or curved first inner surface 20A. The hinge block 20 has an intermediate body portion and a first hinge flange 28 above and spaced from a second hinge flange 27 that project out from the intermediate body portion and form a channel opening along the side. Aligned vertical holes are provided in the hinge flanges which receive and support a hinge pin 29 for pivotally supporting a side wall 24. A pair of laterally spaced lugs 37 on the outside at the top of block 20 receive a cover hinge pin 36 to pivotally support the cover 35.

The guide and latch block 21 is in the form of an upright second end wall extending up from a second end portion of the base 19 and is also symmetrical with respect to a longitudinal center line of the housing so there is identical structure on both sides of the center line and a description of one side applies to the other side. The guide and latch block 21 has an arcuate or curved second inner surface 21A with flat inner surfaces 21B on both sides of the curved second inner surface 21A. The guide and latch block 21 is substantially longer than hinge block 20. The tube exit openings 68 are in the form of an inverted keyhole-shaped slot opening in the top thereof having a flat-sided upper portion and a lower portion of an arcuate shape that is wider than the upper portion to enable the tube to be inserted into each slot through the top opening and be gripped and held in a friction fitting engagement and also provide a guide for the tube.

The side walls 24 extend up from the side edge portion of the base 19 between opposite ends of the blocks 21 and are of identical construction on each side of the longitudinal center line of the housing so a description of one applies to both. Each side wall 24 has a third inner surface 24A extending along a side and part of the base of one half a U-shape to engage and support the tube in a U-shaped configuration. More particularly, each side wall has a straight section and an inclined section with a curved inner surface 24B along the inside of the inclined section and a straight inner surface 24C along the straight section to provide a pair of opposed inner bearing surfaces 44 that interact with the rotor in the pumping action as described hereafter. The inclined section terminates in a narrowed end section of the hinge end portion sized to fit in the channel between flanges 27 and 28 in the hinge block and has an aperture through which the hinge pin 29 extends and supports the side arm to pivot so as to separate one side wall 24 from the other side wall 24 to a spread position.

The latch end portion of the arm 24 has an L-shaped inside step 24D complementary in shape with the corner of the end portion of the block 21 leaving an inwardly projecting rectangular tongue 24E.

A first latch portion L1 at the latch end portion of the arm includes a latch pin 30 extending inwardly from tongue 24E having a head 30A with a conical end surface 30 B and an annular groove 30C located inwardly from the head forming a radially extending first latch face 30D.

A second latch portion L2 at each end of the guide and latch block 21 includes a plunger 31 movable up and down in a vertical hole 32 with the top of the plunger normally projecting above the top of the block 21 and biased in an up position by a spring 34 in hole 32 and when moved down the plunger is in an unlatched position. The end portion of block 21 has a notch 21C opening in the end and the plunger 31 has a cut-out section 31A leaving notch 21C open when the plunger is in the unlatched position. Plunger 31 has an intermediate flat wall portion forming a latch plate 31B with an aperture 31C with a portion of latch plate 31C surrounding the aperture forming a second latch face 31D.

In the latched position the pin head 30A inserts through the aperture 31C and the first latch face 30D engages the second latch face 31D to rigidly lock the side wall to the block 21 in the latched position and is released upon depression of the plunger so the pin head 30A is free to pass through the aperture 31C.

The cover 35 is pivotally connected to the housing to close the top opening in a closed position and open the top opening in an open position. The cover has a window 40 covered by a transparent impact-resistant layer.

Rotor 12 has a radial arm or block provided by an intermediate block 50 and first and second brackets or arm sections 51A and 51B that are each biased outwardly by a compression spring 52. Two rollers 54 are journaled for rotation at opposite ends of the radial arm so as to dispose the rollers 180 degrees to one another in relation to the axis of rotation.

A first hinge point P1 for the first arm section 51A is offset a distance in one direction from said longitudinal center line of the arm allowing the first arm section 51A to pivot in a first direction away from the block 50. A second hinge point P2 for the second arm section 51B is offset a distance in an opposite direction from said longitudinal center line to allow said second arm to pivot in said first direction away from the block 50. The first and second hinge points P1 and P2 are along a common diagonal line through the center of the arm. Each arm section is being biased away from said block by a compression spring 52. Each arm section includes a first flange 56 and a second flange 57 spaced from the first flange. A roller 54 is journaled between the flanges 56 and 57 for rotation. A bolt 53 limits the extent of outward pivotal movement of each of the arm sections. The block 50 has spaced flanges 58, 59 and a hinge pin 60 journaled in bushings 61 to pivotally connect the arm section thereto.

For rotating the rotor 12, the rotor block 50 includes a central bore 62 for receiving and retaining a shaft 63 of the drive motor 14. The motor shaft 63 extends through a hole 64 in the motor housing base 19.

For lifting the rotor pump block 50 from the housing 11, there is provided a rotor handle 65 including a handle arm 66 which is hinged by a handle pin 67 to the rotor pump block 50.

In use, the pump lid 35 is opened and the latch plungers 31 are pressed to open the latches so that the pump side walls 24 can swing outwardly. The rotor 12 is rotated to a position allowing for the insertion of the tube 25 which is a flexible plastic tube. The tube 25 is inserted in exit slots 68 in the guide and latch block 21. The tube 25 is placed between the pump rotor 12 and the side walls 24, and the side walls are closed until they latch shut. The cover 35 is then closed and the pump is ready for operation.

During pumping the tube 25 is squeezed between the internal bearing surfaces 44 and rollers 54 upon rotation of the rotor 12 to produce a pumping action on a fluid in the tube.

Although the present invention has been described with a certain degree of particularity, it is understood that the present disclosure has been made by way of example and that changes in details of structure may be made without departing from the spirit thereof.

What is claimed is:

1. A peristaltic pump and tube loading system comprising:

a housing having two, spaced, tube exit openings, an inner cavity shaped to receive and support a tube in a U-shaped configuration with said tube extending through said openings, opposed inner bearing surfaces, a cover to close an access opening in said housing in a closed position and movable to an open position for insertion of a tube into said housing and removal from said housing, a pair of side walls each hinged at a hinged end portion for pivotal movement laterally away from one another between a latched position and a spread position to facilitate loading said tube into said housing and removal of said tube from said housing in said spread position with said cover in an open position, each side wall having a latch end portion carrying a first latch portion that releasably engages a second latch portion on said housing to rigidly lock each side wall against movement in said latched position, and a rotor rotatably mounted in said housing for rotation about an axis of rotation, said rotor having a radial arm and two rollers journaled for rotation on opposite ends of said arm so as to be disposed at positions located 180 degrees from one another, said tube being squeezed between said bearing surfaces and said rollers upon the rotation of said rotor to pump a fluid in said tube, said housing having a base, a hinge block extending up from a first end portion of said base and having first inner surfaces and a guide and latch block extending up from a second end portion of said base opposite and in spaced relation to said hinge block, said guide and latch block having said two slots opening in the top thereof to provide said tube exit openings.

2. A system as set forth in claim 1 wherein each slot is of an inverted keyhole-like shape having a flat sided upper portion and a wider arcuate lower portion to permit insertion of the tube into said slots to engage said tube in a friction fitting relation and provide a guide for said tube.

3. A system as set forth in claim 1 wherein each said side wall has a straight section providing a straight inner surface defining said cavity and an inclined section providing a curved inner surface defining said cavity.

4. A system as set forth in claim 1 wherein said base has an aperture through which a drive shaft of a drive motor extends and a plurality of apertures through which fasteners extend to fasten said base to a support.

5. A system as set forth in claim 1 wherein said cover has a window covered by a transparent, impact-resistant layer.

6. A system as set forth in claim 1 wherein said radial arm includes an intermediate block having first and second arm sections pivotally connected to opposite ends of said block, each arm section carrying one of said rollers.

7. A system as set forth in claim 6 wherein said block has a first pivot for said first arm section offset a distance in one direction from a center line lengthwise of said block that allows said first arm section to pivot away from said block and a second pivot for said second arm section offset a distance in an opposite direction from said center line to allow said second arm to pivot away from said block, said first and second hinge points being disposed along a common diagonal line through the center of said block.

8. A system as set forth in claim 1 wherein said block has an intermediate body portion and spaced first and second hinge flanges projecting out from said intermediate body portion to form a channel for receiving a narrowed end section of said sidewalls.

9. A peristaltic pump and tube loading system comprising:

a housing having a base, a hinge block extending up from a first end portion of said base and having a first inner surface, a guide and latch block extending up from a second end portion of said base opposite and in spaced relation to said hinge block, said guide and latch block having a second inner surface and two, laterally spaced, tube exit slots opening in the top thereof, a pair of laterally spaced side walls extending up from side portions of said base and extending between opposite ends of said blocks to form an inner cavity shaped to receive and support a tube in a U-shaped configuration with end portions of said tube extending through said slots, said side walls having a pair of opposed third inner surfaces and including a pair of opposed inner bearing surfaces, said tube extending along and in engagement with said first, second and third inner surfaces, said blocks and side walls defining a top access opening above said base, each side wall having a hinge end portion pivotally connected to an end portion of said hinge block to enable said side walls to spread away from one another between a latched position to a spread position to facilitate loading said tube into said housing and removal of said tube from said housing in said spread position, each side wall having a latch end portion including a first latch portion that releasably engages a second latch portion on said guide and latch block to rigidly lock said side wall in a latched position, a cover pivotally connected to said hinge block to close said top access opening in a closed position and movable to an open position to provide access into said housing for removal and replacement of said tube, a rotor rotatably mounted in said housing for rotation about an axis of rotation centrally of said housing and driven by a motor, said rotor having a radial arm and two rollers journaled for rotation at opposite ends of said arm so as to be disposed at positions located 180 degrees to one another, said tube being squeezed between said bearing surfaces and said rollers upon the rotation of said rotor to pump a fluid in said tube.

10. A system as set forth in claim 9 wherein said first latch portion includes a latch pin having a head with a conical end surface and an annular groove axially inwardly of said head forming a radially extending first latch face and said second latch portion includes a flat wall portion with an aperture sized to have said head inserted through said aperture to a latch position whereby a shoulder of said wall portion defining said aperture defines a second latch face that overlaps and engages said first latch face in said latched position.

11. A system as set forth in claim 10 wherein said second latch portion includes a plunger in a vertical hole in said end portion of said guide and latch block, said plunger being biased upwardly to latched position and movable down by force to a latch release position, whereby when said conical end surface moves against said plunger said plunger is caused to retract to the closed position and in the alternative when the plunger is depressed said head may be moved through said aperture and said first latch surface engages said second latch surface in the latched position.

12. A system as set forth in claim 10 wherein said side arm has an L-shaped notch along the inside of said latch end portion of a complementary shape with an adjacent end portion of said guide and latch block so said latch end portion notch receives said end portion of said guide latch block to enable said side wall to extend perpendicular to said guide and latch block in said latched position, and a rectangular tongue portion left in said notch that fits in a notch in said guide and latch block.

13. A peristaltic pump and tube loading system comprising:

a housing having a base, a hinge block extending up from a first end portion of said base and having an inner surface, said hinge block having an intermediate body portion and spaced first and second hinge flanges extending out from said intermediate body portion to form a channel for receiving a narrowed end section of said hinge end portion with a hinge pin extending between said hinge flanges, and a guide and latch block extending up from a second end portion of said base opposite and in spaced relation to said hinge block, said guide and latch block having a second inner surface and a pair of tube exit slots opening in the top thereof, a pair of laterally spaced side walls extending up from side portions of said base and extending between opposite ends of said blocks to form an inner cavity shaped to receive and support a tube in a U-shaped configuration with the end portion of said tube extending through said slot, said side walls having a pair of opposed third inner surfaces and including a pair of opposed inner bearing surfaces, said tube extending along and in engagement with said first, second and third inner surfaces, said blocks and side walls forming a top opening above said base, said side walls having inner surfaces including a pair of opposed inner bearing surfaces, each side wall having a hinge lug at one end extending between said first and second hinge flanges with said hinge pin pivotally connecting said hinge lug to said hinge flanges to enable said side walls to move away from one another to an open position, each side wall having a latch end portion including a first latch portion having a latch pin extending laterally inwardly from each side wall at the other end and extending into a second latch portion including a plunger on said guide and latch block, said plunger being depressed to release the said latch pin and allow said side wall to swing outwardly to facilitate insertion of a tube thereinto, a cover pivotally connected to said housing to close said top opening in a closed position and movable to an open position, a rotor including a radial arm supporting a pair of rollers at opposite ends and centered on a longitudinal center line of said arm and disposed at 180 degrees in relation to one another rotatably mounted in said housing for rotation about an axis of rotation, said radial-arm having an intermediate block and first and second arms sections pivotally connected to said block, each arm section carrying one of said rollers, a first hinge point for said first arm section being offset a distance in one direction from said longitudinal center line allowing said first arm section to pivot in a first direction away from said block, a second hinge point for said second arm section being offset a distance in an opposite direction from said longitudinal center line to allow said second arm to pivot in said first direction away from said block, said first and second hinge points being along a common diagonal line through the center of said arm, each of said first and second arm sections being biased away from said block by a compression spring, each of said first and second arm sections including a first flange and a second flange spaced from said first flange with said roller journaled in said first and second flanges for rotation and a bolt to limit the extent of outward travel of each of said arm sections, and said tube extending between the outer periphery of said rollers opposite said bearing surfaces, said tube being squeezed between said bearing surfaces and rollers upon the rotation of said rotor to produce a pumping action on a fluid in said tube.

14. A peristaltic pump and tube loading system comprising:

a housing having two, spaced, tube exit openings, an inner cavity shaped to receive and support a tube in a U-shaped configuration with said tube extending through said openings, opposed inner bearing surfaces, a pair of side walls each hinged at a hinged end portion for pivotal movement laterally away from one another between a latched position and a spread position to facilitate loading said tube into said housing and removal of said tube from said housing in said spread position, each side wall having a latch end portion carrying a first latch portion that releasably engages a second latch portion on said housing to rigidly lock each side wall against movement in said latched position, and a base, said base having a hinge block extending up from a first end portion of said base and having first inner surfaces and a guide and latch block extending up from a second end portion of said base opposite and in spaced relation to said hinge block, said guide and latch block having said two slots opening in the top thereof to provide said tube exit openings.

15. A system as set forth in claim 14 further comprising a cover attached to the base, said cover movable to and from a closed position and an open position.

16. A system as set forth in claim 15 wherein said cover has a window covered by a transparent, impact-resistant layer.

17. A system as set forth in claim 14 further comprising a rotor rotatably mounted in said housing for rotation about an axis of rotation, said rotor having at least two rollers having contact with said tube so that said tube is squeezed between said bearing surfaces and said rollers upon the rotation of said rotor to pump a fluid in said tube.

18. A system as set forth in claim 14 wherein each slot is of an inverted keyhole-like shape having a flat sided upper portion and a wider arcuate lower portion to permit insertion of the tube into said slots to engage said tube in a friction fitting relation and provide a guide for said tube.

19. A system as set forth in claim 14 wherein each said side wall has a straight section providing a straight inner surface defining said cavity and an inclined section providing a curved inner surface defining said cavity.

20. A system as set forth in claim 14 wherein said base has an aperture through which a drive shaft of a drive motor extends and a plurality of apertures through which fasteners extend to fasten said base to a support.

21. A system as set forth in claim 14 wherein said rotor arm includes an intermediate block and first and second arm sections pivotally connected to opposite ends of said block, each arm section carrying one of said rollers.

22. A system as set forth in claim 21 wherein said block has a first pivot for said first arm section offset a distance in one direction from a center line extending lengthwise of said block that allows said first arm section to pivot away from said block and a second pivot for said second arm section offset a distance in an opposite direction from said longitudinal center line to allow said second arm to pivot away from said block, said first and second hinge points being disposed along a common diagonal line through the center of said block.

23. A system as set forth in claim 14 wherein said block has an intermediate body portion and spaced first and second hinge flanges projecting out from said intermediate body portion to form a channel for receiving a narrowed end section of said sidewalls.

* * * * *